US008622520B2

(12) United States Patent
Shin et al.

(10) Patent No.: US 8,622,520 B2
(45) Date of Patent: Jan. 7, 2014

(54) APPARATUS FOR EJECTING DROPLETS

(75) Inventors: Hyun Ho Shin, Gyeonggi-do (KR); Byung Hun Kim, Gyeonggi-do (KR); Jong Beom Kim, Gyeonggi-do (KR); Jae Chang Lee, Gyeonggi-do (KR); Won Chul Sim, Gyeonggi-do (KR)

(73) Assignee: Samsung Electro-Mechanics Co., Ltd. (KR)

( * ) Notice: Subject to any disclaimer, the term of this patent is extended or adjusted under 35 U.S.C. 154(b) by 0 days.

(21) Appl. No.: 13/532,585

(22) Filed: Jun. 25, 2012

(65) Prior Publication Data

US 2013/0027472 A1 Jan. 31, 2013

(30) Foreign Application Priority Data

Jul. 28, 2011 (KR) ..... 10-2011-0075076

(51) Int. Cl.
*B41J 2/135* (2006.01)
*B41J 2/14* (2006.01)

(52) U.S. Cl.
USPC ..... 347/47; 347/40; 347/44

(58) Field of Classification Search
USPC ..... 347/40, 44, 47
See application file for complete search history.

(56) References Cited

U.S. PATENT DOCUMENTS

| | | | | |
|---|---|---|---|---|
| 4,695,854 | A * | 9/1987 | Cruz-Uribe | 347/40 |
| 2004/0119780 | A1 * | 6/2004 | Usui et al. | 347/40 |
| 2005/0046668 | A1 * | 3/2005 | Owaki | 347/44 |

FOREIGN PATENT DOCUMENTS

| | | | |
|---|---|---|---|
| KR | 10-2008-0054710 | A | 6/2008 |
| KR | 1020080054710 | A | 6/2008 |
| KR | 1020110030185 | A | 3/2011 |

* cited by examiner

*Primary Examiner* — Matthew Luu
*Assistant Examiner* — Alexander D Shenderov
(74) *Attorney, Agent, or Firm* — Blakely Sokoloff Taylor & Zafman

(57) ABSTRACT

Disclosed herein is an ejecting apparatus including: an upper body which includes an inlet through which ejectable fluid flows in from an external source, a channel which fluidly communicates with the inlet and through which the ejectable fluid flows, and an upper mounting portion which fluidly communicates with the channel and is opened downwardly; a lower body which includes a lower mounting portion which is opened upwardly to correspond to the upper mounting portion, and a nozzle slit which fluidly communicates with the lower mounting portion to eject the ejectable fluid to an outside, the lower body being fastened to the upper body, and a nozzle chip which is interposed between the upper mounting portion and the lower mounting portion to receive the ejectable fluid from the channel and discharge the ejectable fluid into the nozzle slit by being driven by an actuator.

10 Claims, 7 Drawing Sheets

- PRIOR ART -

130

130

APPARATUS FOR EJECTING DROPLETS

CROSS REFERENCE(S) TO RELATED APPLICATIONS

This application claims the benefit under 35 U.S.C. Section 119 of Korean Patent Application Serial No. 10-2011-0075076, entitled "Apparatus for Ejecting Droplets" filed on Jul. 28, 2011, which is hereby incorporated by reference in its entirety into this application.

BACKGROUND OF THE INVENTION

1. Technical Field

The present invention relates to an ejecting apparatus which includes a plurality of nozzles, and more particularly, to an ejecting apparatus which can control sizes of droplets to be ejected more minutely and more precisely, stably maintain a nozzle chip under high ejection pressure, and improve durability and reliability.

2. Description of the Related Art

In recent years, there is an attempt to apply a technique of ejecting droplets having a uniform size for a precise process such as ejecting, coating, or printing. For example, since an ink-jet head has a precise nozzle and uses an actuator suitable for the nozzle, the ink-jet head is suitable for ejecting droplets with a uniform size.

FIG. 1 is a cross sectional view schematically illustrating a structure of a related art ink-jet head.

Referring to FIG. 1, a related art ink-jet head includes a nozzle chip 13 which has a plurality of ejecting nozzles and is driven by an actuator 13*a* to eject ejectable fluid through the ejecting nozzles, and an upper bezel 11 which is attached to an upper portion of the nozzle chip 13 by an adhesive.

The nozzle chip 13 has a minute pattern and is made of a material having high brittleness such as silicon or glass. In this case, if high pressure is applied to an inlet 11*a* in order to discharge droplets at a high speed, the nozzle chip 13 and the upper bezel 11 may be separated from each other or the nozzle chip 13, which has high brittleness, may be damaged due to high pressure exerted to a channel 12.

Due to the above problems, it is difficult to apply the related art ink-jet head to the case in which the droplets should be ejected at high speed.

SUMMARY OF THE INVENTION

An object of the present invention is to provide an ejecting apparatus which has a nozzle chip 13 for a related art ink-jet head but can eject droplets stably without break away from the nozzle chip or damage to the nozzle chip even under high discharge pressure of 10 bar or more.

Another object of the present invention is to provide an ejecting apparatus which can stably discharge droplets with uniform sizes.

According to an exemplary embodiment of the present invention, there is provided an ejecting apparatus including: an upper body which includes an inlet through which ejectable fluid flows in from an external source, a channel which fluidly communicates with the inlet and through which the ejectable fluid flows, and an upper mounting portion which fluidly communicates with the channel and is opened downwardly; a lower body which includes a lower mounting portion which is opened upwardly to correspond to the upper mounting portion, and a nozzle slit which fluidly communicates with the lower mounting portion to eject the ejectable fluid to outside, the lower body being fastened to the upper body, and a nozzle chip which is interposed between the upper mounting portion and the lower mounting portion to receive the ejectable fluid from the channel and discharge the ejectable fluid into the nozzle slit by being driven by an actuator.

The upper body and the lower body may be fastened to each other by a bolt.

An aligning protrusion may be disposed along an edge of the upper mounting portion, and an aligning recess corresponding to the aligning protrusion may be disposed along an edge of the lower mounting portion.

Of course, the aligning recess may be disposed along the edge of the upper mounting portion and the aligning protrusion to be assembled with the aligning recess may be disposed along the edge of the lower mounting portion.

The ejecting apparatus may further include a first sealing member disposed along an edge of the channel.

The ejecting apparatus may further include a third sealing member disposed along an edge of the nozzle slit.

The ejecting apparatus may further include a first packing member and a second packing member which are disposed between the upper mounting portion and the nozzle chip and the lower mounting portion and the nozzle chip, respectively, to correspond to each other.

The nozzle chip may be connected to a flexible printed circuit board (FPCB) for controlling driving of the actuator, a connector hoard connected to the FPCB, and a connector connected to the connector board, in sequence, and the upper body may include a cavity which fluidly communicates with the upper mounting portion and the outside so as to provide a space in which the FPCB, the connector board, and the connector are mounted.

The ejecting apparatus may further include a sealing cover which is disposed on the upper body to expose an end portion of the connector to the outside and seal the cavity.

The nozzle chip may include a plurality of flow cells which receive the ejectable fluid from the channel and discharge the ejectable fluid into the nozzle slit.

The actuator may include a plurality of piezoelectric elements which are independent from one another, wherein the plurality of piezoelectric elements correspond to the plurality of flow cells, respectively.

DESCRIPTION OF THE PREFERRED EMBODIMENTS

Figure 1:
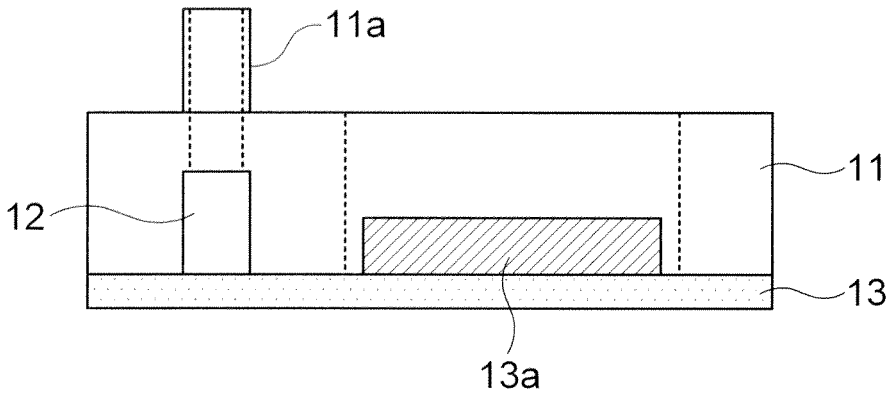
FIG. 1 is a view schematically illustrating a related art ejecting apparatus.

Hereinafter, exemplary embodiments will be described in greater detail with reference to the accompanying drawings. In the following descriptions, same reference numerals and signs are used for the same elements when they are depicted in different drawings and an additional description thereof will be omitted.

Hereinafter, an ejecting apparatus according to an exemplary embodiment will be explained in more detail with reference to FIGS. 2 to 12.

Figure 2:
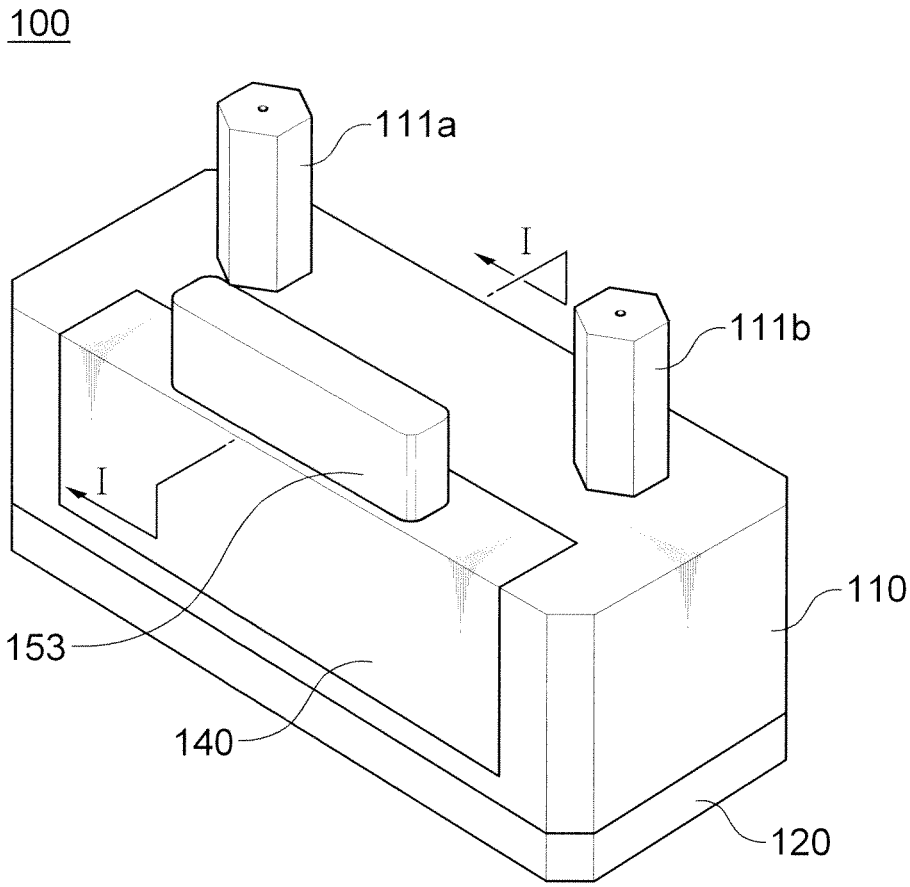
FIG. 2 is a perspective view schematically illustrating an ejecting apparatus according to an exemplary embodiment.
Figure 3:
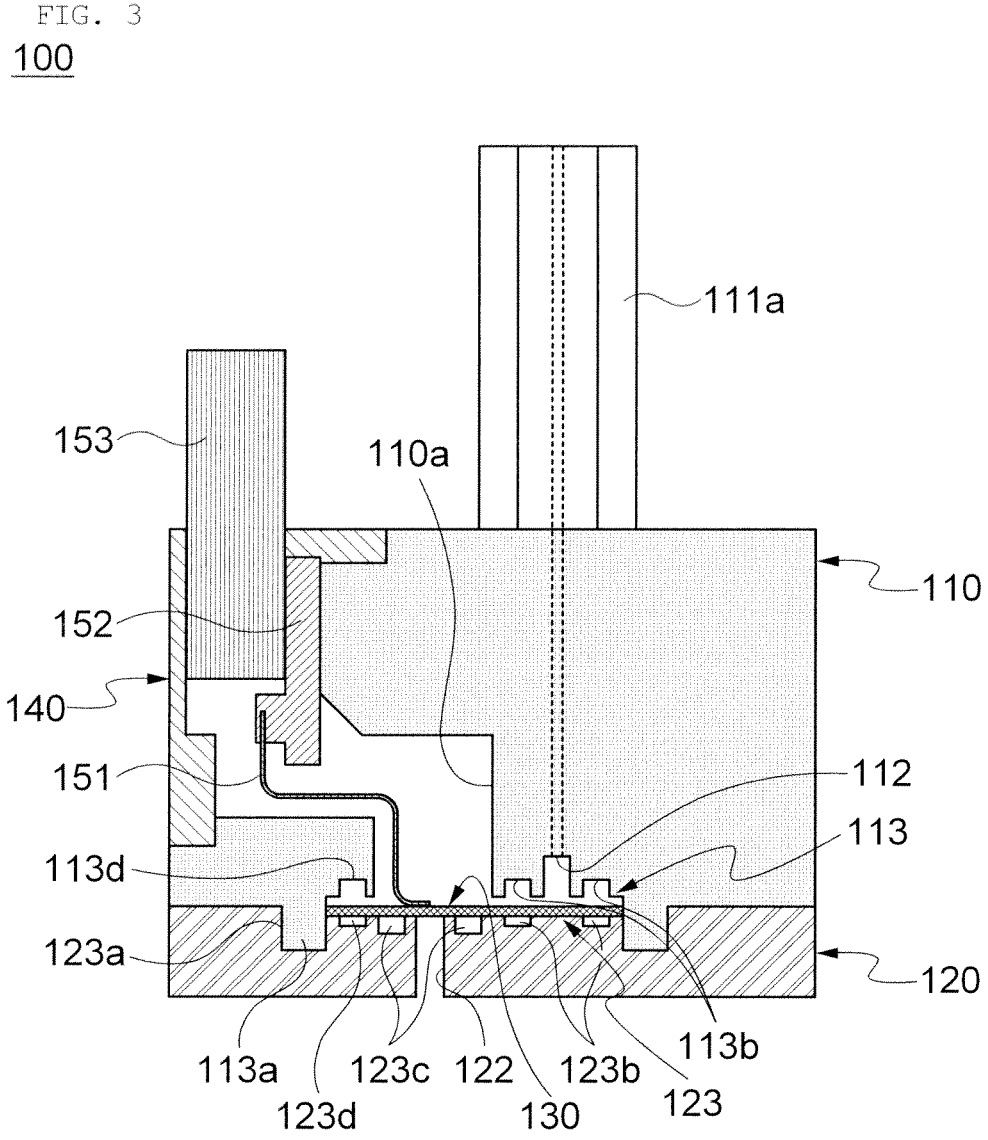
FIG. 3 is a cross sectional view taken along line I-I of FIG. 2.
Figure 4:
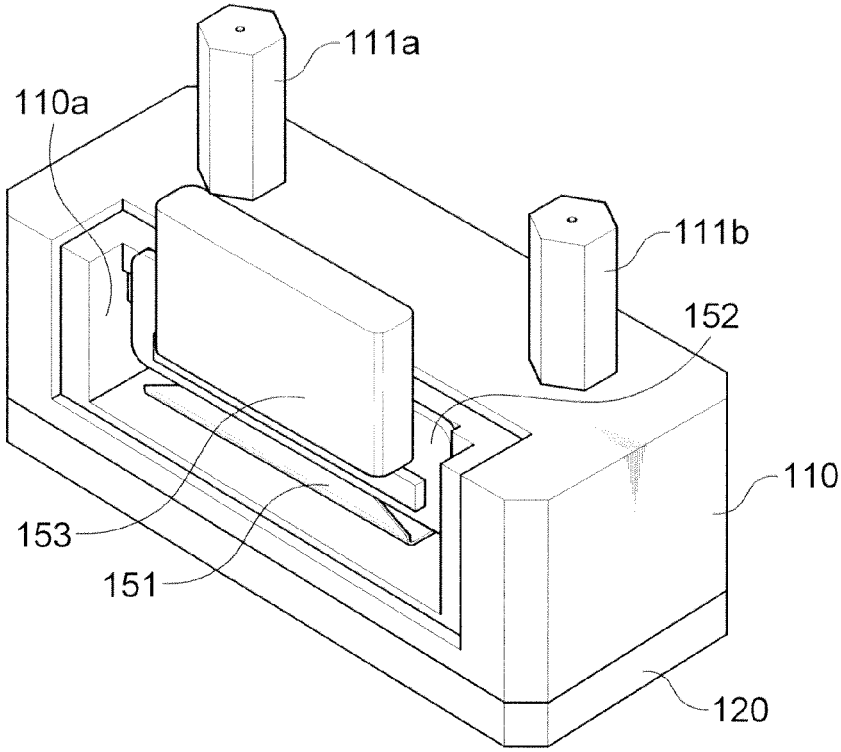
FIG. 4 is a schematic perspective view of FIG. 2 from which a sealing cover is removed.
Figure 5:
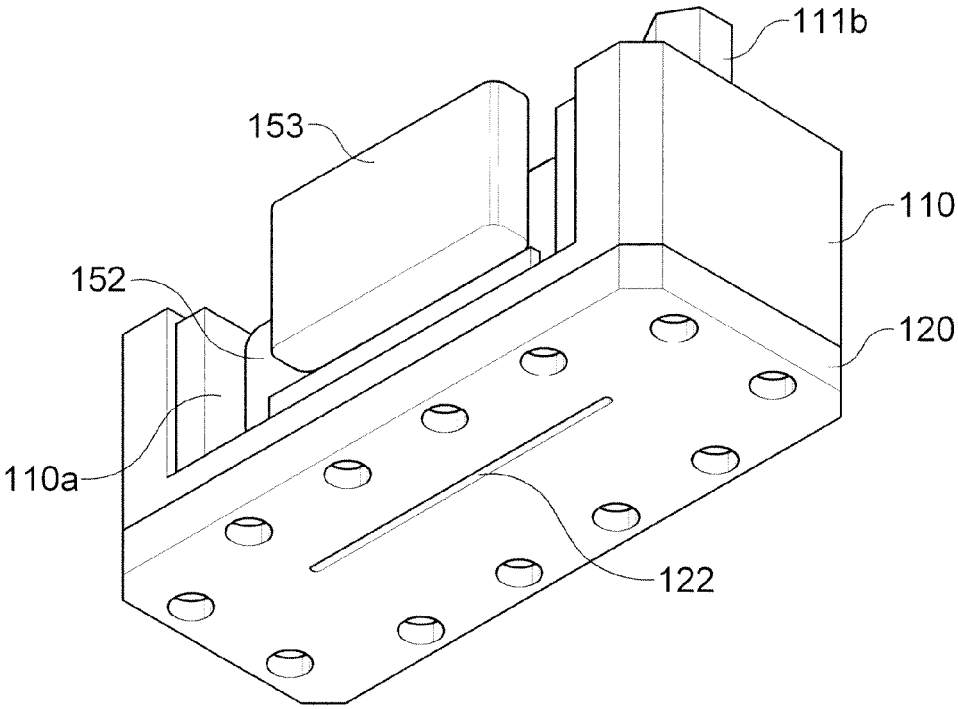
FIG. 5 is a bottom perspective view of FIG. 4.
Figure 6:
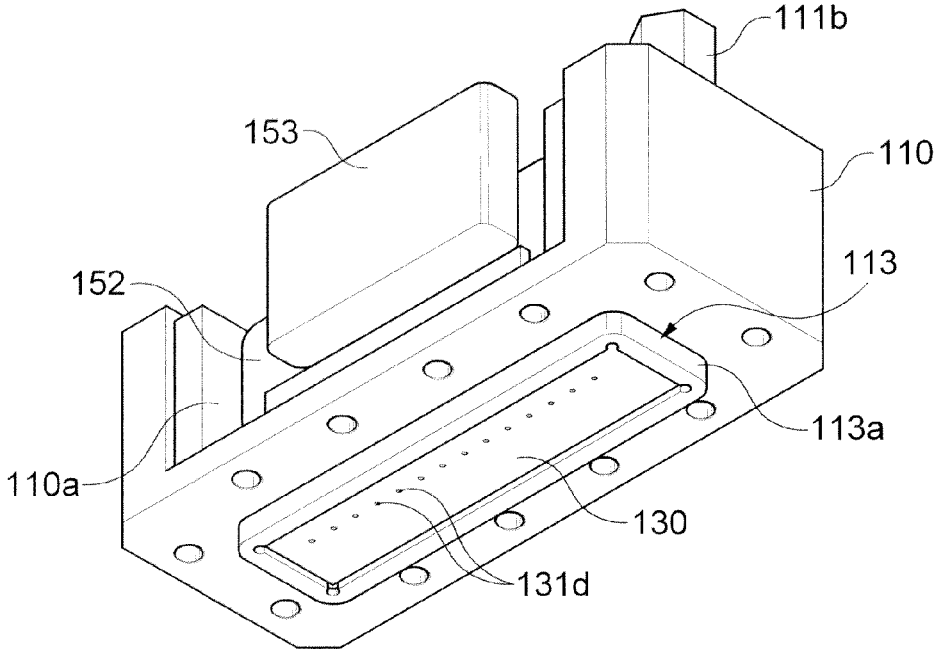
FIG. 6 is a schematic perspective view of FIG. 5 from which a lower bezel is removed.
Figure 7:
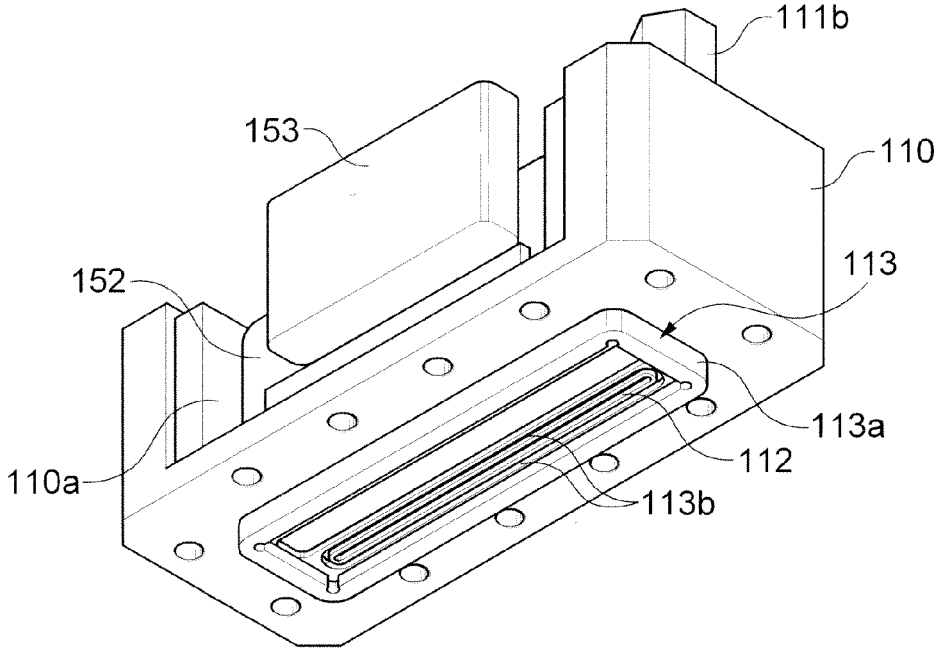
FIG. 7 is a schematic perspective view of FIG. 6 from which a nozzle chip is removed.
Figure 8:
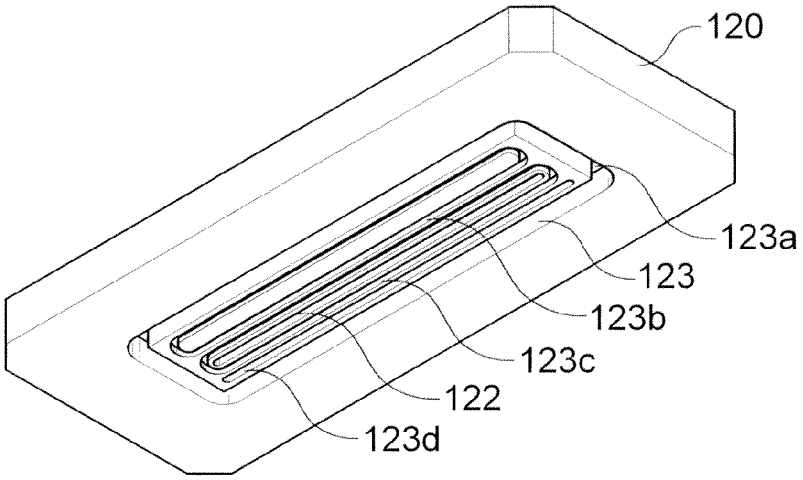
FIG. 8 is a schematic perspective view of the lower bezel of FIG. 5 seen from above.
Figure 9:
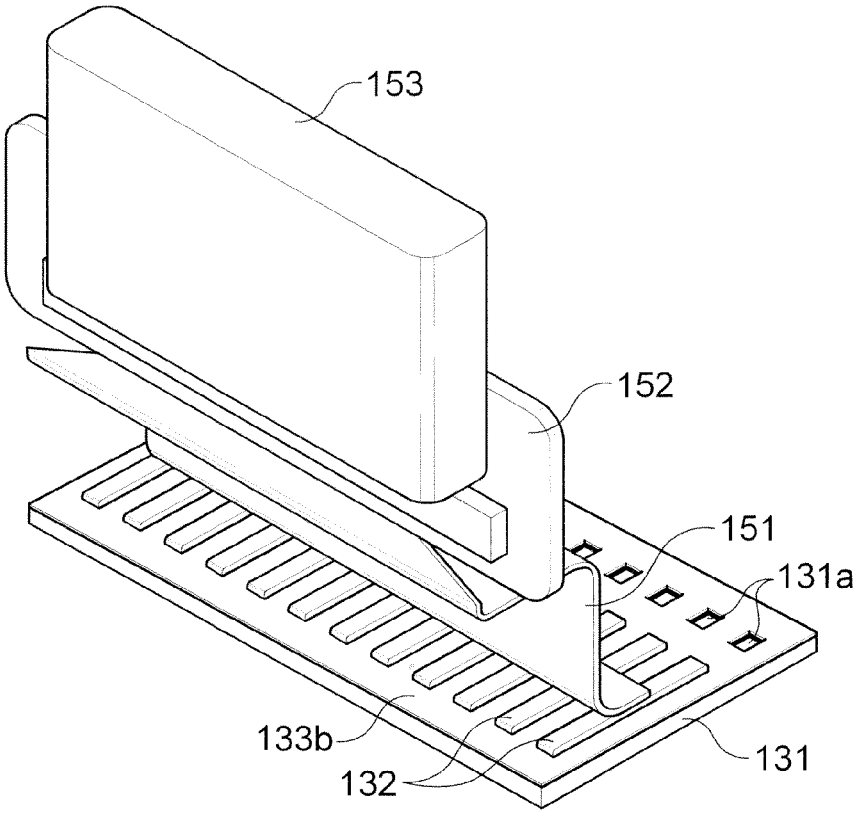
FIG. 9 is a schematic perspective view illustrating main parts, a flexible printed circuit board, a connector board, and a connector, which are connected to the nozzle chip of FIG. 3 in sequence.
Figure 10:
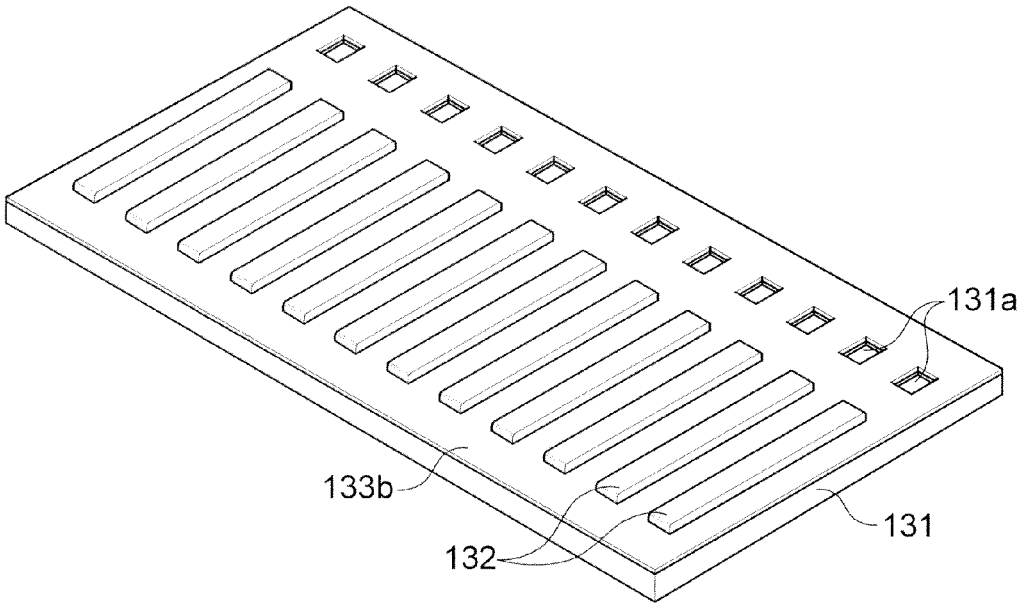
FIG. 10 is a perspective view schematically illustrating the nozzle chip applied to the ejecting apparatus according to the exemplary embodiment.
Figure 11:
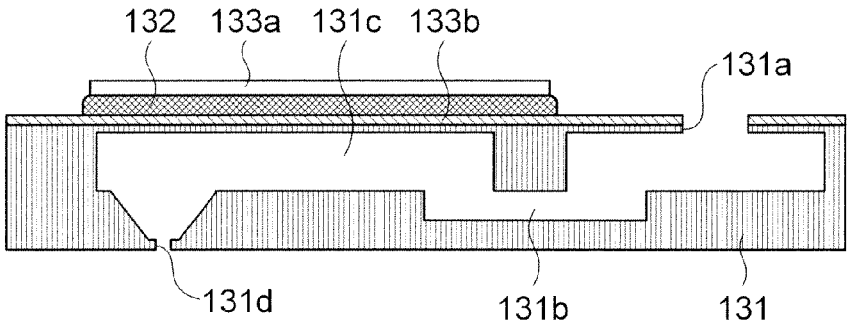
FIG. 11 is a cross sectional view schematically illustrating the nozzle chip of FIG. 10.

FIG. 2 is a perspective view schematically illustrating an ejecting apparatus according to an exemplary embodiment, FIG. 3 is a cross sectional view taken along line I-I of FIG. 2, FIG. 4 is a schematic perspective view of FIG. 2 from which a sealing cover is removed, FIG. 5 is a bottom perspective view of FIG. 4, FIG. 6 is a schematic perspective view of FIG. 5 from which a lower body is removed, FIG. 7 is a schematic perspective view of FIG. 6 from which a nozzle chip is removed, FIG. 8 is a schematic perspective view of the lower body of FIG. 5 seen from above, FIG. 9 is a schematic perspective view illustrating main parts, a flexible printed circuit board, a connector board, and a connector, which are connected to the nozzle chip of FIG. 3 in sequence, FIG. 10 is a perspective view schematically illustrating the nozzle chip applied to the ejecting apparatus according to the exemplary embodiment, and FIG. 11 is a cross sectional view schematically illustrating the nozzle chip of FIG. 10.

Referring to FIGS. 2 to 8, an ejecting apparatus 100 according to an exemplary embodiment generally includes an upper body 110, a lower body 120, and a nozzle chip 130.

The upper body 110 may include an inlet 111*a* through which ejectable fluid flows in from an external source, a channel 112 which fluidly communicates with the inlet 111*a* and through which the ejectable fluid flows, and an upper mounting portion which fluidly communicates with the channel 112 and is opened downwardly. The upper body 110 may include an outlet 111*b* corresponding to the inlet 111*a*.

The lower body 120 may include a lower mounting portion 123 which is opened upwardly to correspond to the upper mounting portion 113 of the upper body 110, and a nozzle slit 122 which fluidly communicates with the lower mounting portion 123 to eject the ejectable fluid to the outside. The lower body 120 is fastened to the upper body 110 to accommodate the nozzle chip 130 along with the upper body 110.

In addition, the nozzle chip 130 may be manufactured by performing a micro electro mechanical system (MEMS) process such as direct bonding and etching with respect to a silicon wafer, and be interposed between the upper mounting portion 113 of the upper body 110 and the lower mounting portion 123 of the lower body 120 to receive the ejectable fluid from the channel 112 and discharge the ejectable fluid into the nozzle slit 112 by being driven by an actuator 132 (see FIG. 11).

In this configuration, the upper body 110 and the lower body 120 may be fastened to each other by a bolt. Accordingly, the nozzle chip 130 may be stably accommodated in the upper body 110 and the lower body 120.

Meanwhile, an aligning protrusion 113*a* may be formed along an edge of the upper mounting portion 113, and an aligning recess 123*a* corresponding to the aligning protrusion 112*a* may be formed along an edge of the lower mounting portion 123.

Accordingly, the aligning protrusion is connected to the aligning recess 123*a* so that the upper body 110 and the lower body 120 are provisionally assembled with each other before being fastened to each other by the bolt.

Although not shown, the aligning recess 123*a* may be formed along the edge of the upper mounting portion 113 and the aligning protrusion 113*a* may be formed along the edge of the lower mounting portion 123 to be assembled with the aligning recess 123*a*.

Meanwhile, the ejecting apparatus 100 according to the present embodiment may have a first sealing recess 113*b* of an annular shape formed along an edge of the channel 112 and may have a first sealing member (not shown) formed in the first sealing recess 113*b*. The first sealing member may be, but not limited to, an O-ring, Accordingly, the first sealing member prevents leakage of the ejectable fluid supplied to the nozzle chip 130 through the channel 112, and, even if ejection pressure of the ejectable fluid is high, the first sealing member mitigates shock applied to the nozzle chip 130, thereby preventing damage to the nozzle chip 130.

In this configuration, the lower mounting portion 123 may further include a second sealing recess 123*b* corresponding to the first sealing recess 113*b*, and a second sealing member (not shown) may be formed in the second sealing recess 123*b*. The second sealing member may also be, but not limited to, an O-ring.

Accordingly, along with the first sealing member, the second sealing member are disposed on the upper portion and the lower portion of the nozzle chip 130 in which the channel 112 is formed, thereby preventing shear stress from occurring at the nozzle chip 130 even under high ejection pressure and thus maintaining the nozzle chip 130 more stably.

The ejecting apparatus 100 according to the present embodiment may further include a third sealing recess 123*c* formed along an edge of the slit 122 of the lower bezel 120 and a third sealing member (not shown) formed in the third sealing recess 123*c*. The third sealing member may also be, but not limited to, an O-ring.

Accordingly, the third sealing member may prevent leakage of the ejectable fluid discharged from the nozzle chip 130 and ejected through the nozzle slit 122, and also mitigates a shock exerted to the nozzle chip 130 even if the ejection pressure of the ejectable fluid is high.

Meanwhile, the ejecting apparatus 100 according to the present embodiment may further include first and second packing recesses 113*d* and 123*d* in a bar shape formed at end portions of the nozzle chip 130 through which the ejectable fluid is discharged and corresponding to the upper mounting portion 113 and the lower mounting portion 123, respectively, and may further include first and second packing members (not shown) formed in the first and the second packing recesses 113*d* and 123*d*.

In this configuration, the first and the second packing members may be made of the same material as that of the first, the second, and the third sealing members such as silicon rubber, but are not limited to this material and may be formed of any other material that can achieve tightness and buffering.

Meanwhile, referring to FIGS. 3 and 9, the nozzle chip 130 is connected to a flexible printed circuit board (FPCB) 151 for controlling driving of the actuator 132, a connector board 152 connected to the FPCB 151, and a connector 153 connected to the connector board 152 in sequence.

The upper body 110 may include a cavity 110*a* fluidly communicating with the upper mounting portion 113 and the outside so as to provide a space in which the FPCB 151, the connector board 152, and the connector 153 are mounted.

The ejecting apparatus 100 according to the present embodiment may further include a sealing cover 140 to expose an end portion of the connector 153 to the outside so that the connector 153 is connected to a cable (not shown), and also to seal the cavity 110*a*.

Accordingly, the ejecting apparatus 100 according to the present embodiment may increase a waterproofing property against mist caused by scattering of very minute moisture. At this time, since the connector 153 is exposed to the outside, a waterproofing connector may be applied.

Referring to FIGS. 10 and 11, the nozzle chip 130 may include a plurality of flow cells to receive the ejectable fluid from the channel 112 of the upper body 110 and discharge the ejectable fluid into the nozzle slit 122 of the lower body 120 in the form of a plurality of droplets.

All of the plurality of flow cells fluidly communicate with the channel 112, but may be configured in the form of an independent channel.

More specifically, the nozzle chip 130 may include a nozzle body 131 manufactured by performing an MEMS process with respect to a silicon wafer as described above, and the plurality of flow cells may be formed on the nozzle body 131.

Each of the flow cells includes an inlet 131*a* fluidly communicating with the channel 112 to receive the ejectable fluid, a chamber 131*c* fluidly communicating with the inlet 131*a*, a restrictor 131*b* to connect the inlet 131*a* and the chamber 131*c*, and an ejection nozzle 131*d* to discharge the ejectable fluid supplied to the chamber 131*c* into the nozzle slit 122 in the form of droplets. A channel between the chamber 131*c* and the ejection nozzle 131*d* is funnel-shaped such that a size of the channel gradually decreases toward the ejection nozzle 131*d*, and serves as a damper.

The actuator 132 may be disposed on an upper portion of the nozzle body 131 adjacent to the ejection nozzle 131*d*, a lower electrode 133*b* may be disposed between the nozzle body 131 and the actuator 132 to propagate driving by an electric pulse of the actuator 132 toward the nozzle body 131, and an upper electrode 133*a* may be disposed between the FPCB 151 and the actuator 132 to input the electric pulse to the actuator 132 through the aforementioned FPCB 151.

The actuator 132 may include a plurality of independent piezoelectric elements corresponding to the plurality of flow cells and accordingly is able to drive the plurality of flow cells of the nozzle chip 130 independently and thus control the sizes of the droplets of the ejectable fluid minutely and precisely.

Figure 12:
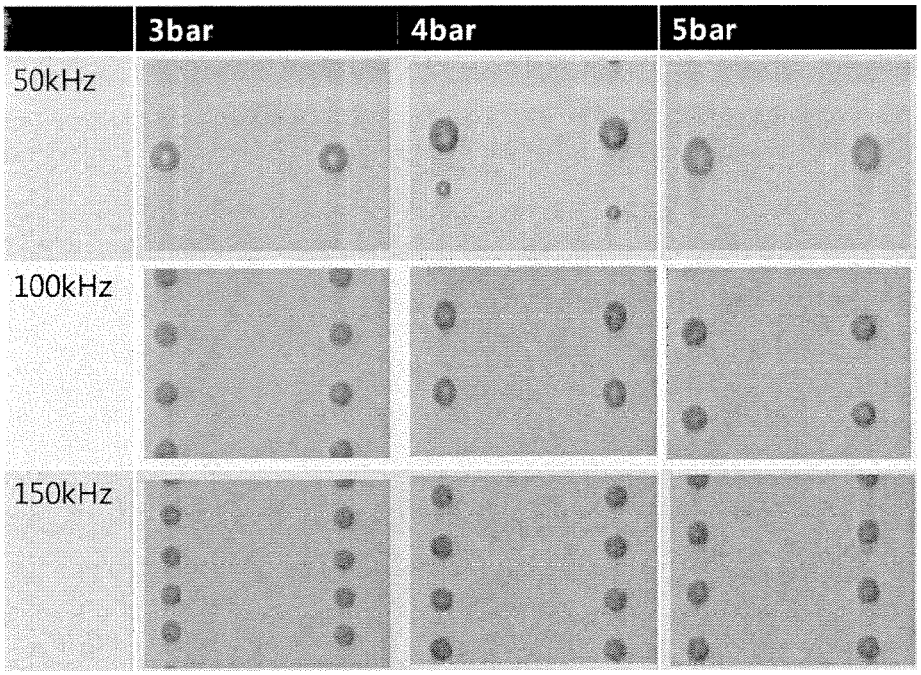
FIG. 12 is a view illustrating photographed images of sizes of droplets of fluid ejected by the ejecting apparatus of the present invention according to a driving frequency and an ejection pressure of an actuator.

Meanwhile, FIG. 12 shows photographed images of the size of droplets of ejectable fluid ejected by the ejecting apparatus of the present invention according to a driving frequency and an ejection pressure of the actuator. As shown in FIG. 12, if ejection pressure of 3, 4, and 5 bar is applied and a speed is constantly fixed, and if driving frequency of 50, 100, and 150 kHz of the actuator 132, that is, of the piezoelectric elements is applied in sequence, as the driving frequency increases, the size of the droplet is reduced and the droplet has a uniform size, while merging of the droplets is prevented. That is, it can be seen that, by controlling the driving frequency of the actuator, the size of the droplet can be easily controlled.

As described above, the ejecting apparatus according to the present invention can maintain the nozzle chip even under high ejection pressure, thereby preventing damage to the nozzle chip and the ejecting apparatus having the same and thus improving durability and reliability.

Also, according to the ejecting apparatus of the present invention, it is possible to drive the plurality of flow cells of the nozzle chip independently and thus control the size of the droplets of the ejected fluid minutely and precisely. Therefore, the ejecting apparatus can be applied to various fields that require precise ejecting.

While the present invention has been shown and described in connection with the embodiments, it will be apparent to those skilled in the art that modifications and variations can be made without departing from the spirit and scope of the invention as defined by the appended claims.

What is claimed is:

1. An ejecting apparatus comprising:

an upper body which includes an inlet through which ejectable fluid flows in from an external source, a channel which fluidly communicates with the inlet and through which the ejectable fluid flows, and an upper mounting portion which fluidly communicates with the channel and is opened downwardly;

a lower body which includes a lower mounting portion which is opened upwardly to correspond to the upper mounting portion, and a nozzle slit which fluidly communicates with the lower mounting portion to eject the ejectable fluid to outside, the lower body being fastened to the upper body;

a nozzle chip which is interposed between the upper mounting portion and the lower mounting portion to receive the ejectable fluid from the channel and discharge the ejectable fluid into the nozzle slit by being driven by an actuator; and a first packing member and a second packing member which are disposed between the upper mounting portion and the nozzle chip, and the lower mounting portion and the nozzle chip, respectively, to correspond to each other.

2. The ejecting apparatus according to claim 1, wherein the upper body and the lower body are fastened to each other by a bolt.

3. The ejecting apparatus according to claim 1, wherein an aligning protrusion is disposed along an edge of the upper mounting portion, and an aligning recess corresponding to the aligning protrusion is disposed along an edge of the lower mounting portion.

4. The ejecting apparatus according to claim 1, further comprising a first sealing member disposed along an edge of the channel.

5. The ejecting apparatus according to claim 4, further comprising a second sealing member disposed on the lower mounting portion to correspond to the first sealing member.

6. The ejecting apparatus according to claim 1, further comprising a third sealing member disposed along an edge of the nozzle slit.

7. The ejecting apparatus according to claim 1, wherein the nozzle chip is connected to a flexible printed circuit board (FPCB) for controlling driving of the actuator, a connector board connected to the FPCB, and a connector connected to the connector board, in sequence, and the upper body includes a cavity which fluidly communicates with the upper mounting portion and the outside so as to provide a space in which the FPCB, the connector board, and the connector are mounted.

8. The ejecting apparatus according to claim 7, further comprising a sealing cover which is disposed on the upper body to expose an end portion of the connector to the outside and seal the cavity.

9. The ejecting apparatus according to claim 1, wherein the nozzle chip includes a plurality of flow cells which receive the ejectable fluid from the channel and discharge the ejectable fluid into the nozzle slit.

10. The ejecting apparatus according to claim 9, wherein the actuator includes a plurality of piezoelectric elements which are independent from one another, the plurality of piezoelectric elements corresponding to the plurality of flow cells, respectively.

* * * * *